US009217604B2

(12) United States Patent
Åbyhammar

(10) Patent No.: US 9,217,604 B2
(45) Date of Patent: Dec. 22, 2015

(54) MEANS FOR DRYING OF A PARTICULATE MATERIAL WITH A GAS

(76) Inventor: Tomas Åbyhammar, Stockholm (SE)

( * ) Notice: Subject to any disclaimer, the term of this patent is extended or adjusted under 35 U.S.C. 154(b) by 1127 days.

(21) Appl. No.: 13/256,416

(22) PCT Filed: Mar. 2, 2010

(86) PCT No.: PCT/SE2010/050240

§ 371 (c)(1),
(2), (4) Date: Nov. 4, 2011

(87) PCT Pub. No.: WO2010/104454

PCT Pub. Date: Sep. 16, 2010

(65) Prior Publication Data

US 2012/0036731 A1 Feb. 16, 2012

(30) Foreign Application Priority Data

Mar. 13, 2009 (SE) ..... 0900334

(51) Int. Cl.

| | |
|---|---|
| ***F26B 11/02*** | (2006.01) |
| ***F26B 3/00*** | (2006.01) |
| ***F26B 11/00*** | (2006.01) |
| ***F26B 17/22*** | (2006.01) |
| ***F26B 17/12*** | (2006.01) |

(52) U.S. Cl.
CPC ..... *F26B 17/22* (2013.01); *F26B 17/124* (2013.01)

(58) Field of Classification Search
CPC ..... F26B 11/0409; F26B 11/0413; F26B 11/0431; F26B 11/0418; F26B 11/10; F26B 11/181; F26B 11/188; F26B 17/05; F26B 17/005; F26B 17/22
USPC ..... 34/184–187, 81, 82, 175, 235, 443, 34/480, 487, 587, 593, 147, 507, 108, 114, 34/142; 366/9, 338, 339, 266, 83, 76.4, 366/154.1–154.4, 277, 227, 228, 157.2, 1, 366/57.3, 157.4; 131/53, 305
See application file for complete search history.

(56) References Cited

U.S. PATENT DOCUMENTS

| | | | |
|---|---|---|---|
| 1,669,012 A | 5/1928 | Nordström | |
| 3,646,688 A | 3/1972 | Osterman | |

(Continued)

FOREIGN PATENT DOCUMENTS

| | | | |
|---|---|---|---|
| EP | 0 341 196 A2 | 11/1989 | |
| EP | 0341196 A2 * | 11/1989 | ..... B01D 46/34 |

*Primary Examiner* — Kenneth Rinehart
*Assistant Examiner* — John McCormack
(74) *Attorney, Agent, or Firm* — Dickstein Shapiro LLP

(57) ABSTRACT

A device to bring a gas into contact with a particulate solid bulk material, comprising a first and a second tubular, radially gas-permeable element (1, 2) having different diameters and which each define a central axis, wherein one of the elements is essentially coaxially placed in the second element, wherein the elements (1, 2) internally define a ring-shaped shaft (30) for a material (40) that is to be contacted by the gas, wherein the elements have essentially vertically oriented axes, a ventilation device (50) for compelling the gas radially through the shaft and the material, a first device (41) for addition of the material to an upper end of the shaft (30) and a second device (31-36) for output of dried material from the lower end of the shaft. Driving means (12) are provided for internal displacement of the elements (1, 2). At least one of the walls is provided with at least one screw line ramp which maintains a high porosity and a controlled feeding of the material.

8 Claims, 2 Drawing Sheets

(56) References Cited

U.S. PATENT DOCUMENTS 4,126,411 A * 11/1978 Moller et al. ..... 432/80
4,444,509 A * 4/1984 Steiner et al. ..... 366/157.2
4,797,092 A 1/1989 Pieper
4,914,834 A * 4/1990 Sime ..... 34/169
2007/0294911 A1 12/2007 Wilson

* cited by examiner

MEANS FOR DRYING OF A PARTICULATE MATERIAL WITH A GAS

TECHNICAL FIELD OF THE INVENTION

The invention relates to a device according to the preamble of the appended independent device claim.

The invention thus relates to a device, by which a particulate bulk material is brought into direct contact with a flow of gas for transmitting material and energy.

PRIOR ART

Treatment of a solid material with large amounts of gas takes place in several industrial processes, especially at drying of moist material such as barque, shingle, grain, malt, fermenting residues, animal feed, foodstuff and mud. By dryer is intended a device where a solid material is affected by contacting a tempered gas with a solid material to attain a desired process in the solid material, for example drying, adsorption, evaporation, cooling, germination, roasting, torrefaction etc. If the gas contains hot steam, especially water steam, the material can be effectively heated and/or moisturized in the contact with this hot steam. By steam and moist is here referred to the solvent, for example water which is released from the material that is being treated. Air is intended to include a permanent gas, for example air, nitrogen gas or stack gas.

Today air, or stack gas, with a high temperature is normally used to carry out drying processes. Systems using high speed conveying of gas and material are common. All in all, the systems of today lead to high consumption of heating and operating energy, large dust formation and fire hazard. If the process is run at lower temperatures, several of the said inconveniences can be reduced. Drying with low temperature or with low temperature difference, a large flow of gas is however required to add the required heat and to remove residue products, for example moisture.

If a person chooses to work with high gas speed at the contact between gas and material so that the material is transported with the gas, a large amount of dust will follow the gas out of the apparatus, also after use of fairly costly separating systems. Further, a significant ventilation work is required to perform the process.

If a person chooses to work with low gas speed and a stationary bed of the material, a large cross section area is required. If the material is inhomogeneous, a very low gas speed is required to prevent local fluidization and thereby subsequent dust spread. If the thickness of the material in the direction of the gas can be kept thin, the need for ventilation work is significantly smaller than for example in the cases where the material is transported with the gas.

There are several solutions with horizontal beds of porous bulk material. A disadvantage with these is that they will require a lot of space and that laying operations, transport and gathering of the material require a lot of mechanical equipment. To reduce these problems, people are tempted to use relatively deep beds which leads to large pressure fall for the gas and thereby a demand for a lot of electric energy to the ventilating fans. The increasing height also leads to increased strains on the transportation equipment since the moist material at increased storage height is increasingly more difficult to transport.

If a person instead chooses to work with a vertical bed and a horizontal gas flow, several undesired phenomena will occur. The height leads to that the porosity in the drying material is reduced, which in turn leads to larger pressure drops and an uneven distribution of the passing gas. The increasing height also leads to that the moist particles are pressed together so that the adhesion between these increases so that the particles that move freely at the surface further down in the bed appear as a more or less stiff lump that does not easily change shape and position in the way that is required at the transportation of the drying material through the contact apparatus. The adhesion between the particles, foremost for fibrous and long granulated material leads to a strong tendency to create aggregates and bridges that disturb or prevent the movement of the material. Since a bridge often is balanced by an empty space or an area with higher porosity under the bridge, also this phenomenon leads to an uneven distribution of the gas that passes through the material.

Similar ways to design vertical beds have been suggested earlier. In U.S. Pat. No. 6,699,012 is described an apparatus with 2 concentric, fixed, cylindrical, perforated walls where the gas passes radially. At the bottom there is a rotating disc for output. Both walls are perforated. None of the walls have any conveyors and none of the walls are moveable. The main characteristic of this device is said to be a screen for splitting of the gas flow so that gas with a high energy content can be circulated.

EP 0 341 196 A2 describes a similar apparatus where one or both of the walls can be turned. The gas flow takes place radially but in such a way that the input as well as the output takes place through the outer wall. The inner wall and the central space thereby constitute only a turning chamber for the gas that thereafter flows back towards the outer wall. The wall is turned by an outer factor so that the material is lifted next to the movable wall despite that the main direction of the material is downwards. The purpose is to reduce bridge formation and through vertical and radial movements loosen up and even out differences in the material. A static pressure is raised in the material by an upwards transportation, which should prevent the loosening of the material. The rotation of the wall is always accomplished by an outer factor. The shaft is wedge-shaped with a smaller width at the lower end. The material is pushed out at the bottom with the aid of blades that displace the material towards an output shaft located by the rotation centre.

At all stationary beds that are pervaded by gas, the treatment of the material will be completed earlier on the side where the gas is let in, compared with on the side where the gas leaves the material. There is thus a need to turnover the material close to the inlet of the gas faster than other material. Many inventors of band driers have tried to achieve this function, mainly by various mechanical devices in many cases so that a certain part of the taken material is returned and another part leaves the system in a finished state.

SUMMARY OF THE INVENTION

A purpose of the invention is to provide a device by which one or many of these problems completely or partly are eliminated.

The purpose is attained by a device according to the invention, such as it is defined in the characterizing part of claim 1. Preferred embodiments and developments of the invention are specified in the subclaims.

The invention thus relates, in one embodiment, to a contact device of the type that comprises a first and a second tubular, radially gas-permeable element having different diameters and together defining a hollow shaft, wherein one of the elements is essentially coaxially placed in the second element, wherein the elements have essentially vertically oriented axes, screw line ramps on the walls that creates a controlled friction between wall and material so that compression of the material is avoided, a device to create a relative movement between the elements, a ventilation device for compelling a drying gas radially through the elements and an in-between placed particulate material to be treated, a first device for addition of the material to an upper end of the tubular chamber, and a second device for unloading the dried material at the lower end of the chamber.

Unique for the invention is that the material moves downwards while it is carried by the walls through screw line ramps (to maintain the porosity) as well as contributes to revolving the movable wall through influence of the weight of the material as well as by the screw ramps and that the rotation can be assisted by means of the movable wall, is given an axial upwards and downwards movement. Effects of this are that the mechanical strains on the turning wall are significantly reduced when the torque moment is locally generated near the friction surfaces instead of externally.

BRIEF DESCRIPTION OF THE DRAWINGS

The invention will be described more in detail below in connection with embodiment examples according to the invention, shown in the drawings, whereby FIG. 1 schematically shows an axial section through a first embodiment of the drying device according to the invention.

DETAILED DESCRIPTION OF THE INVENTION

Figure 1:
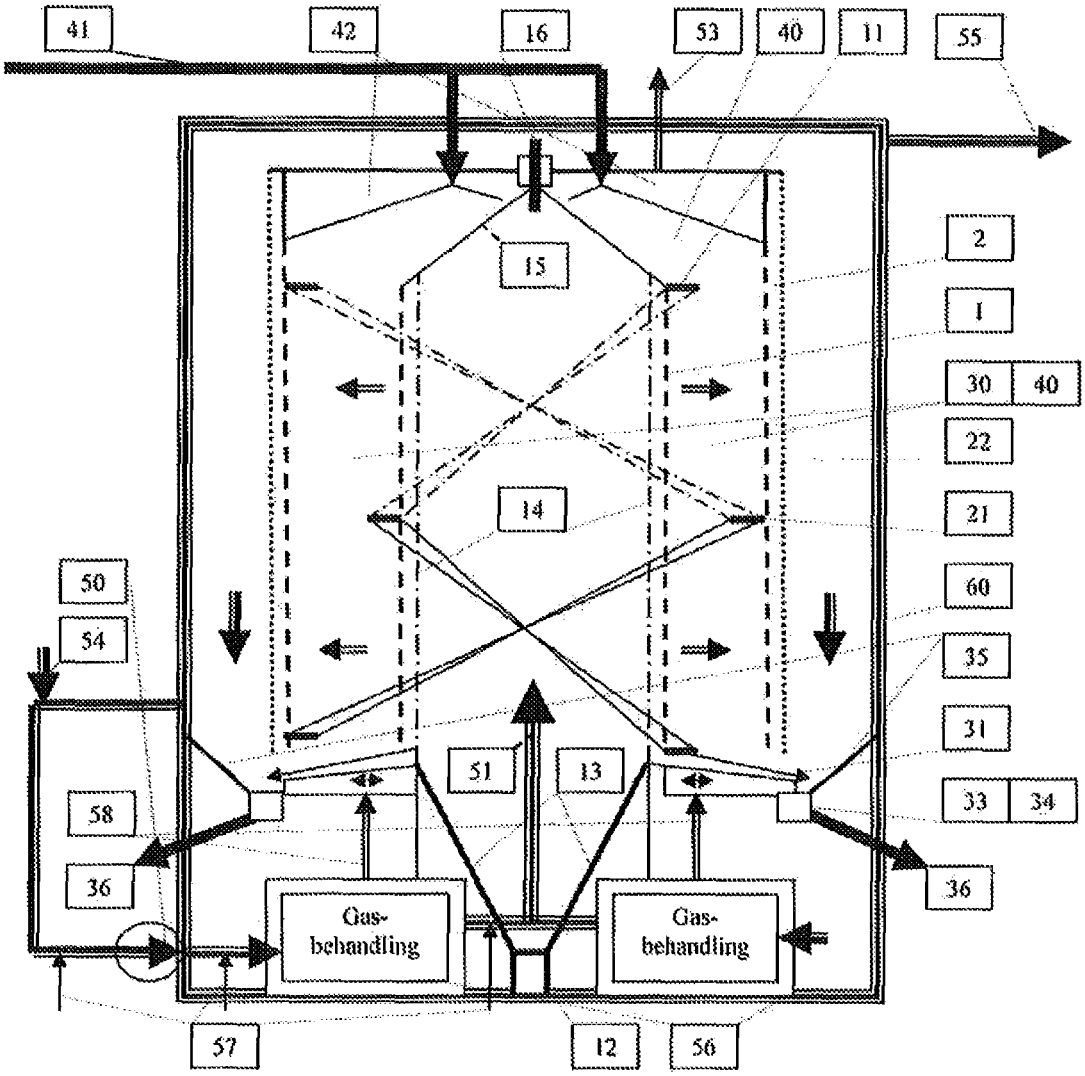

FIG. 1 shows a schematic axial section through a first embodiment of a drying device according to the invention which comprises a hole cylindrical (tubular) shaft 30, which is defined by two coaxial tubular elements 1, 2 which are arranged permeable by gas, but not or only partly for a particulate material 40, which is received in the tubular shaft 30 between the walls 1, 2. Over the shaft is a storage space 42 with delivery lines for material that is to be treated (drying goods). The storage room is always filled so that a cavity in the shaft immediately can be filled with new material. The bottom of the shaft is constituted by an output disc 31, which is arranged to release material in a controlled manner from the lower end of the shaft 30 to a collecting vessel 33, which has a device for tangential transportation 34 towards one or several outlets 36. The bottom consists of one or several discs 31 having ring shape, which are separately rotating around the axis of the drying device or radially displaceable around this axis. The upper surface of the output disc is given a geometry for example in the form of spirals, stairs or conveyors so that the flow of material from the shaft 30 is given a certain radial profile so that the output is larger at the wall 1 where the gas has its inlet.

In FIG. 1, the outer shaft wall 2 is illustrated as stationary while the inner shaft wall 1 is carried by a supporting and carrying construction 13, 14 for dislocation of the wall 2 with the aid of a device 12 that allows for rotation of the wall 1 and can also contain an active rotation and/or lifting function.

In the upper part of the figure is shown an input device 41 for the particle material. Further it can be seen that the inner wall 1 at its upper end has a lid 15 that deflects added particle material to the shaft 30. The lid exhibits a central axis 16 for journaling and controlling of the wall 1. Gas can optionally be lead into the inner space inside the shaft 30 through the axis 16 if this is tubular (see FIG. 2).

In the lower part is shown that the supporting and carrying construction 13 for the tubular wall 1 has a lower part that also serves as an inlet channel for drying medium 51. The upper part of the supporting and carrying construction 14 can for example consist of a perforated jacket that constitutes a tubular screen so that any material that departs in a radial direction inwards through the wall 1 can fall downwards between the wall 1 and the screen where the material hits an outside downwards sloping ramp at the lower part of the wall 1, so that such material can be led out preferably together with remaining material by means of the output disc 31.

The gaseous drying medium 51 is compelled by one or several ventilating fans 50 that are placed in the direction of the gas within or outside the confinement of the apparatus. The gas is for example treated by dust cleansing, dehumidification and heating in the gas treatment 56 to the desired physical state, and flows in radial direction outwards through the walls 1 and 2 by means of the intermediate material 40. Also the reversed flow direction can be applied. If the gas is dehumidified to a sufficient extent in the gas treatment 56 it can be fully circulated in a gas-wise sealed process, which has a number of advantages. To supplement the heat addition in the gas treatment 56, steam of low pressure can be added in several different positions 57. Steam can also be added to restrain or extinguish fire.

Among other things to prevent blurred emissions from the apparatus, a smaller flow of gas 53 is sucked from the upper part of the apparatus. When this flow is sucked out from the apparatus, the corresponding volume will be sucked in through the openings towards the surroundings that are in the apparatus, mainly openings for transportation in and out of the material. If the material that is being treated emits combustible substances, the formation of explosive concentrations can be prevented through the output of gas in flow 53. Flow 53 is taken out after contact with cold incoming material so that the energy content of the gas is low. The size of the flow is adjusted with respect to the explosion limit and leakage hazard.

The apparatus can also be used for drying with externally added gas 54 which after treatment leaves the apparatus as flow 55 while a certain circulation can occur.

A house 60 is shown surrounding the actual drying device. The house 60 has in FIG. 1 an intermediate level 35 that is sloping inwards downwards towards the output vessel 33 or the output disc 31. The intermediate level also serves as a pressure separating element. According to the embodiment in FIG. 1 the output is taken care of by the units 31-36.

Figure 2:
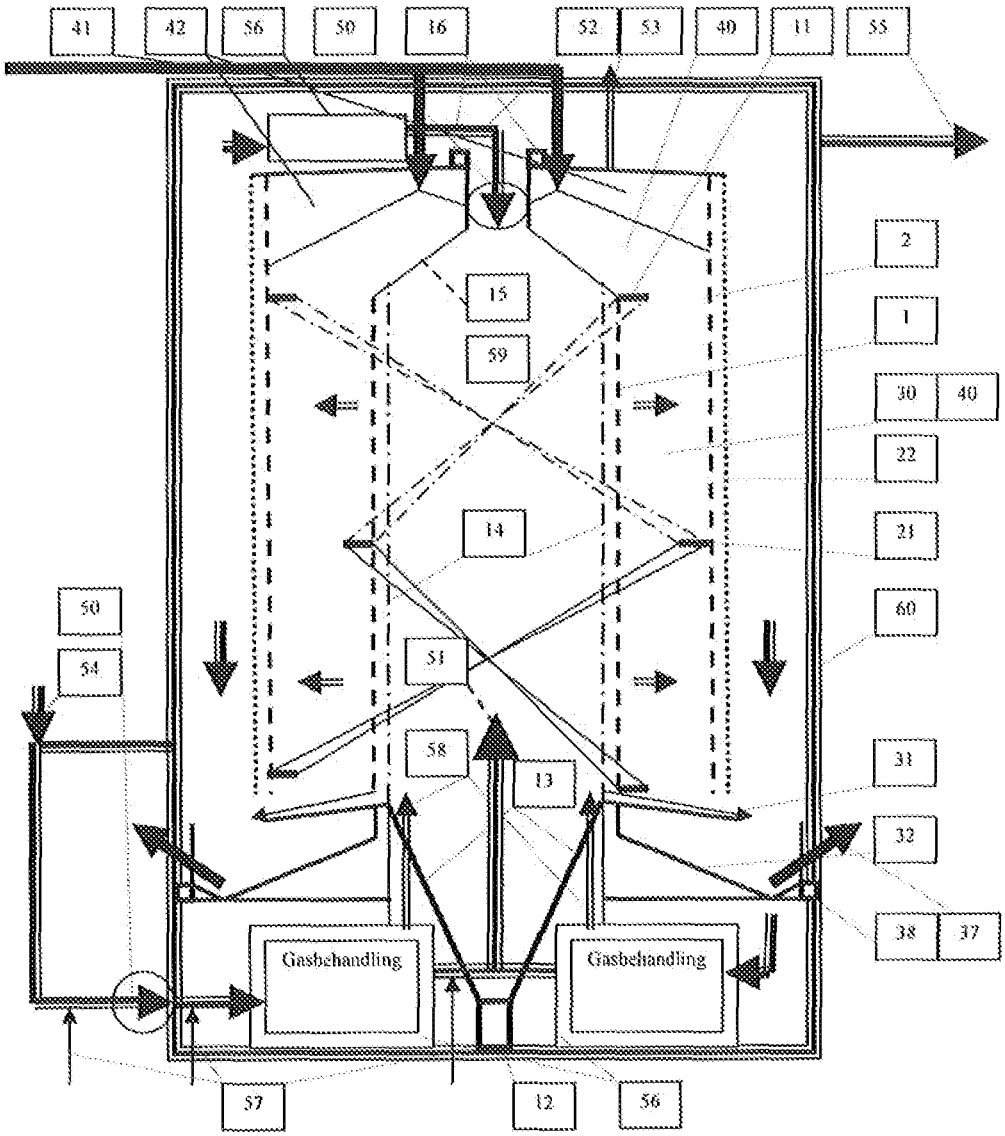
FIG. 2 shows an axial section through a second embodiment of the drying device according to the invention.

FIG. 2 shows an embodiment where the output disc 31 and the vessel 33 are built jointed and are given a larger diameter that connects and seals towards the house 60 and are made able to rotate and thereby also the devices for tangential transport 34 can be replaced. The unit is called output roundabout 32. A stationary conveyor 37 is illustrated to lift the material up out of the roundabout 32 and out of the apparatus. The roundabout 32 in FIG. 2 thereby gives the corresponding functions as 31-35 in FIG. 1.

The material can in principle get stuck in the narrow shaft 30 in such a manner that the gravitation is not able to move the material. The static pressure from the material placed above gives a static pressure that compresses the material and impedes the pervasion of the gas. The static pressure also influences the walls which can lead to strong bridges or plugs. If the material is caught in the shaft an operation disturbance occurs that can be very difficult to heave. To allow for sales of an apparatus of this type it must be provided with a system that can heave a blockage under all circumstances. A relative movement between the shaft walls constitutes a secure way to achieve this aim. The static pressure in the material that arises at increasing height however reduces the porosity and impedes the flow of the gas through the material.

In the drawings is shown that the turnable shaft wall 1 on its outer periphery carries a screw line ramp 11 whose extension from the shaft wall 1 constitutes at least 10% of the radial dimension of the shaft. The upwards inclination of the ramp 11 is preferably ca 1:1 but it can be in the area from 1:2 to 2:1. The radial dimension of the ramp is preferably maximum 40% of the radial dimension of the shaft. Such a screw ramp can carry the material 40 so that it does not lead to a significant contribution to the static material pressure in the lower part of the shaft. The ramp 11 further offers the advantage that when it is rotating towards one side it feeds the material near the shaft wall 1 downwards. At the same time the relative movement between the walls 1 and 2 makes it possible for all the material in the shaft to move downwards in connection with the movement that is created between the layers. The ramp also has a desired profile that to a large extent contributes to the strength of the cylindrical wall. Other structures with corresponding function would impede the stream of gas or material while they would create undesired depositions of sluggish material.

When the relative movement between the walls ceases, the inner friction of the material will recreate bridges etc, which creates a collected friction between the walls and the material so that the walls through the ramps carries the main part of the weight of the material. To maintain a high porosity several ramps are required on the wall so that the distance in height between the ramps is limited to a height that is characteristic for the material. Typical distance/measurements is 1-2 m for compressible materials with moderate porosity, for example sawdust. If the material is more porous for example bark and wood chips or less compressible for example grains, the measurement can be increased.

A controlled friction between the walls and the material is thus important to maintain the porosity of the material in the shaft. Such as is shown in the drawing figure, also the other shaft wall 2 can carry one or several ramps 21, preferably with reversed inclination direction and otherwise of the same type as the previously mentioned screw ramp. The same inclination direction can come into question if material with long rigid particles that can get caught between the coils, is to be treated. The screw line ramp can naturally be divided in mutually subsequent length sections with intermediate interruptions, but it is preferred that the screw line ramp essentially is continuous.

The upper storage space 42 is intended to always be filled with drying goods. Output of material from the lower part of the shaft 30 is facilitated via movements in the systems 31-37. When the displaceable wall is brought to motion, the bridges that prevent the flow of the material will be broken so that the material will be more movable vertically and aims to fill the spaces that have been created over the output devices. The material can then flow vertically in the space between the screw line ramps and helically within the screw line ramps closer to each wall, respectively.

The feeding in the shaft is compelled by the gravitation and is ensured by internally displacing the movable wall 1 around or along its axis, compared to the fixed wall 2. The bridges and aggregates created by the friction when the material is resting, are broken when the material moves so that a controlled feeding is created through the shaft. The flow of material as well as gas is more even distributed in the shaft 30. The mutual movement of the walls 1 and 2 can for example be achieved in the following ways:

- Rotation of a movable wall (1 or 2) with the aid of an outer torque directed for transportation downwards.
- A wall (1 or 2) that can be turned, which in connection with output of material, rotates as a consequence of the weight with which the material rests against the screw line ramps on the wall, when an empty space is formed in the lower part of the shaft 30.
- Vertical forced movement upwards and downwards by a movable wall (1 or 2) which in turn leads to rotation of the wall by influence of screw line ramps.
- Simultaneously lifting and rotation of a movable wall with a collected movement with an upwards inclination that coincides with the inclination of the ramps of the wall followed by the lowering of the wall to its original level.
- Rotation of a movable wall with the aid of an outer torque directed for transportation upwards so that the moment is transferred through the material to the opposite wall so that a downwards movement is created in the material at the opposite wall whose ramps have the opposite inclination direction.

Rotation is naturally a very efficient way to achieve an adequate feeding of the material. An isolated turning of one of the shaft walls however requires a very large torque which is difficult and expensive to create, to transfer to the element and to transfer along the element. According to the invention rotation is created primarily with the aid of the screw line ramps. When the material has favorable characteristics, the rotation is compelled by the movement of the material, and in other cases by one of the walls 1 and 2 being vertically displaced. Thereby, the screw line ramps create the desired rotation "in situ" without an external torque influencing the element. In view of the strains that are created in the movable element at a conventional solution with an external torque, this solution is very favorable. To minimize the mechanical strains when using an external torque, lifting and rotation can take place as a collected movement in a direction that corresponds to the inclination of the screw line ramp. The aim is then that the movable wall and its screw line ramps will "drill" up through the material when lifting. When the wall thereafter is lowered, the material close to the wall will with certainty follow the movement of the wall downwards.

Of course, yet another gas permeable tubular wall or filter jacket 22 can surround the wall 2 on its outside, whereby the other wall has smaller openings, to prevent fine particles from departing radially from there. The particles that have been captured by the filter jacket 22 can sediment downwards and depart through the bottom of the inner shaft (between 2 and 22) to the output devices.

The rotation of the movable wall also leads to a compulsory transport downwards at the rotation, as well as when it is lowered. New material is added at the top from the storage room. When one of the shaft walls is rotating, it will give the whole mass of material a turning force. In this rotation, the mass of material near the opposite jacket will be screwed downwards by the ramp of the opposite wall. The division into an inner, an intermediate and a radial outer tubular material layer leads to advantages at the shown type of cross current contact between the material and the gas.

The screw ramps 21, 11 together have a radial extension that is equal to more than 20% of the radial width of the shaft 30. The screw ramps give the apparatus several very desirable properties. They allow for a secure transport of the material while the build-up of a static pressure in the shaft is limited. These are two of the most prominent reasons as to why vertical designs for compressible bulk goods with a large inner friction are often avoided. A third feature is that the ramps constitute very valuable elements from a strength point of view, and that the spiral form makes them self-cleaning, with regard to undesired remaining material.

When the material has been put out from the bottom of the shaft, the material in the shaft strives to, by its own weight, move downwards through the shaft. Most solid materials are however strongly inclined to create bridges between close surfaces, which makes it more difficult to achieve an even feeding of the material. At the same time it is desired that the material is carried by the walls when the material is resting. The build-up of a static pressure in the shaft, is impeded by the screw ramps 11, 21 on the respective walls 1, 2 in that bridges that carries the material are created. When one of the walls and the ramp is displaced, the bridges will be broken so that the material becomes movable. The material between the guide laps of the ramps is moving downwards when the bottom disc 31 is brought in motion. The speed of the movement, the length of the stroke, and the design of the disc determines how much material that is put out.

The design of the disc also determines the distribution seen in radial length, by the material that is put out. Since the material needs to be exchanged more quickly nearby the wall where the gas flows in, the disc is designed so that more material is put out at every movement closest to this wall and less material closer to the opposite wall.

By letting the shaft wall 1 and 2 have relatively large openings, the gas flow through the shaft can be kept relatively high, despite low ventilation effect, which leads to a good treatment capacity and also gives a favorable moisture profile in the radial direction for the material 40, while fine particles that departs through the outer shaft wall 2 can be collected by the filter jacket 22.

If the perforation of the wall by the inlet is made so big that a significant part of the drying goods can pass, the drying goods by this wall will be exchanged even faster because the material leaves the shaft this way. On the condition that the material that in such a manner falls through the wall, also can be transported out from the apparatus, a certain degree of counter-current between the material and gas is achieved, which in many cases is desired, since the rest of the material thereby is given a larger volume and thereby a longer treatment time in the shaft.

The gas that pervades the shaft can also be split into different flows where each flow is adjusted to meet a certain requirement in the process. The splitting takes place outside the shaft and does not affect the material transport in the shaft.

If dusting is a problem despite the separation in the filter jacket 22, feeding of the material can take place intermittently and the gas flow can be stopped or screened for the concerned part of the apparatus when feeding takes place.

The gas flows across the shaft with a suitable speed with typical values in the interval 0.2-1.5 m/s measured on the free cross section. The material is prevented from fluidizing in that the wall on the downstream side retains the material. Thereby, it is possible to work with higher gas speed than in devices with a free surface on the outlet side. The gas speed should however not exceed the speed where the friction pressure drop compacts the material so that the flow resistance increases as a consequence of the gas flow. The choice of suitable gas speed is affected mostly by an optimizing between the cost for ventilation work versus the plant cost for a larger cross section area in the device, but also by the inconveniences by dust formation.

At several processes, a longer contact time is required for the gas, the longer the process proceeds. This is the fact at for example drying. To achieve a longer contact time and lower gas speed while the process proceeds, the shaft can be constructed reversed wedge-shaped so that the width of the material in the flow direction of the gas increases lower down in the shaft. Other processes require longer retention times at the beginning of the process. Even though it is not shown more in detail on the drawing, the radial dimension of the shaft can vary between the upper and lower ends of the shaft, so that the radial thickness of the material layer is larger at the upper or lower end of the shaft. It is preferred that the radial dimension of the shaft is larger at the lower part of the shaft.

FIG. 2 shows an embodiment where the gas circulates internally in the apparatus. This illustrates a drying process where the gas is dehumidified and heated after every passage. Firstly, the dehumidification is intended to be effected by hygroscopic absorption of the solvent but cooling/condensation and reheating with the aid of a heat pump or external systems is also possible. As is indicated in FIG. 1, the apparatus can also be used for contact with pervading gas from the surroundings (air) or from an external source. For example a warm, dry gas can be used for treatment (drying or gasification) of the material in the shaft. Alternatively, an externally added gas can be treated, which contains substances one wishes to separate in the material, for example through filtration, absorption or adsorption.

Drying and many other processes can require that the gas constantly, completely or partly is renewed. In that case, the gas flow is arranged for pervasion of externally added gas where gas is drawn off to the surroundings or to another system after contact with the material bed 30.

In FIG. 1 is shown that the house 80 can contain a means 56 for heating and humidifying of the moist gas that leaves the material bed 30, so that the heated and/or dehumidified gas can be reintroduced to the bed. Further is shown in FIG. 2 that water vapor 57 can be introduced into the house to moisten the moist gas and through condensation increase the energy state of the treated material 30 and thereby the whole system. By heating the material to a temperature near the boiling point for the solvent (water), the gas will primarily consist of steam and only to a smaller part of air from the surroundings. If the steam is not combustible, it creates a good protection against fire and explosion in the apparatus.

By designing the apparatus so that gas can be led on or off at the lower end as well as at the upper end in the centre cylinder, more gas can be circulated through a cylinder with a given diameter. Thereby it is also possible to increase the capacity of the apparatus by giving it an increased height. Further, a splitting of the gas flow is possible in two circulation systems; an upper and a lower, as is apparent from FIG. 2.

If the gas circulation in the apparatus mainly is closed, advantages are achieved in the form of very low discharge of gas, dust and heat from the apparatus to the surroundings. If the aim is to dry the material, the circulating gas must be dehumidified and/or heated before it is brought back to the material. Instead of dehumidifying, a part of the gas can be altered with more dry externally added gas, for example outside air. If the gas in the apparatus consists partly of a permanent gas and partly of the solvent (for example moist air) several interesting functions can be achieved with two circulation systems.

The input material is normally cold. That is why it will be necessary with addition of heat to the system to achieve and maintain a certain desired working temperature in the apparatus.

When moist air is contacted with the cold input material, the steam condensates against the cold material. The gas in the upper part will be enriched with air. The discharging gas that is contacted with cold material is thereby constituted by a relatively cold and dry air with a low energy content. Gas that is brought away from the system should be taken from this flow with low energy, to minimize the energy consumption. Another possibility is that heat with relatively low temperature can be added to the dryer by reheating and/or moistening this air flow which thereafter is brought back to the system.

The design with two circulation systems is thus interesting for increasing the capacity at a given diameter of the apparatus (for example a limitation at transportation) or if it is desired to use heat of a low temperature. Further, an increased refractoriness in the lower part of the apparatus is achieved.

Yet another possibility is that a smaller amount of external dry air is brought to the lower part of the shaft where the material transfers heat and moisture to the gas meanwhile the dried material is cooled. If this air thereafter is brought to the upper part of the apparatus, heat is recovered to a significant extent to the input cold material. Parallel or alternatively, air from the upper zone can be brought back instead of air from the surroundings, which improves the heat economizing further. This gas flow can consist of dry gas from the following sources: the surroundings, the upper part of the apparatus, dehumidified gas from the gas treatment.

Unexpected effects:

Compared to a horizontal structure, a large effective area in the apparatus is attained on a very limited ground surface.

The screw line ramps combine several functions:

- to maintain the porosity through the friction that is created at rest.
- to abrogate friction and secures a controlled material flow at movements.
- to give the wall a desired rigidity through the horizontal profile of the ramp.
- the spiral shape and placement of the ramp make the stiffening profile self-cleaning of remaining material that otherwise constitutes a fire hazard.
- the spiral shape can create the desired turning of the wall from an axial movement, which is significantly easier to apply than a turning movement.
- the strains on the wall are significantly smaller when the turning is created internally than when an external torque must be added externally.

By means of the profiled output disc with this "typical counter-current apparatus", a significantly faster turnover can be achieved for the material for which the treatment is completed. A larger degree of counter-current between particles and gas can be achieved in the apparatus through a "limited leakage" in the inlet wall.

The invention claimed is:

1. A device to bring a gas into contact with a particulate solid bulk material, comprising a first and a second tubular, radially gas-permeable element having different diameters and which each defining a central axis, wherein one of the elements is essentially coaxially placed in the second element, wherein the elements, mutually define a ring-shaped shaft for a particulate material which is to be contacted by the gas, wherein the elements have essentially vertically oriented axes, a ventilation device for compelling the gas radially through the shaft and the material, a first device for addition of the material to an upper part of the shaft and a second device for output of dried material from a lower part of the shaft, wherein the elements on their side facing the material carry at least a screw line ramp, and at least one of the elements is turnable, wherein the turnable element is liftable so as to achieve an axial relative displacement between the elements and said screw line ramp is arranged so that a rotational movement of the turnable element carrying said screw line ramp around the central axis arises through the influence of said at least one screw line ramp in combination with the particulate solid bulk material.

2. The device according to claim 1, wherein the the turnable element is actively rotated around its central axis.

3. Device according to claim 1, further comprising an output device comprising at least one ring-shaped or polygonal bottom disc at the lower end of the shaft for output of dried material from a bottom part of the shaft.

4. Device according to claim 3, wherein the output device is designed with a geometrical shape and/or conveyors giving a desired distribution of the output flow from the shaft in a radial direction.

5. Device according to claim 1, wherein each screw line ramp extends a radial extension from a shaft wall amounting to between 10 and 50% the radial distance between the elements.

6. Device according to claim 1, wherein the second element is at a radial distance surrounded by a filter jacket for separation of fine particles which have passed through the openings of the second element.

7. Device according to claim 1, wherein gas pervasion openings of the first element exhibit such a size that substantially all of the particulate material can pass through the first element.

8. Device according to claim 5, wherein each screw line ramp extends a radial extension from the shaft wall amounting to 20% of the radial distance between the elements.

* * * * *